US007111806B2

(12) United States Patent
Craig

(10) Patent No.: US 7,111,806 B2
(45) Date of Patent: Sep. 26, 2006

(54) SPOOL FOR SUPPLY OF IMAGE RECEIVING MEDIUM

(75) Inventor: James Craig, Newtown, CT (US)

(73) Assignee: Esselte, St. Niklaaas (BE)

( * ) Notice: Subject to any disclaimer, the term of this patent is extended or adjusted under 35 U.S.C. 154(b) by 0 days.

(21) Appl. No.: 10/911,512

(22) Filed: Aug. 5, 2004

(65) Prior Publication Data

US 2006/0027698 A1 Feb. 9, 2006

(51) Int. Cl.
*B65H 75/24* (2006.01)

(52) U.S. Cl. ..... 242/608.7; 242/578.2; 242/118.5; 242/614

(58) Field of Classification Search ..... 242/578, 242/578.2, 118.6, 118.61, 118.5, 607, 608, 242/608.2, 608.6, 608.7, 614, 609, 609.1
See application file for complete search history.

(56) References Cited

U.S. PATENT DOCUMENTS

| | | | | |
|---|---|---|---|---|
| 3,017,133 | A * | 1/1962 | Bowler | 242/578.2 |
| 3,081,960 | A | 3/1963 | Howe | |
| 4,129,266 | A | 12/1978 | Masiello | |
| 4,358,064 | A * | 11/1982 | Garneau | 242/441.3 |
| 4,428,546 | A | 1/1984 | Weideman | |
| 4,566,785 | A | 1/1986 | Takenouchi | |
| 4,629,136 | A | 12/1986 | Vallance | |
| 6,079,662 | A * | 6/2000 | Miller et al. | 242/571.2 |
| 6,230,999 | B1 * | 5/2001 | Tanaka | 242/578.2 |
| 6,315,235 | B1 * | 11/2001 | Breyer et al. | 242/422.4 |
| 2002/0017588 | A1 | 2/2002 | Kitayama | |

FOREIGN PATENT DOCUMENTS

| | | |
|---|---|---|
| DE | 2 245 573 | 3/1974 |
| DE | 33 12 178 | 10/1984 |
| EP | 1 297 965 A2 | 4/2003 |
| EP | 1 297 965 A3 | 4/2003 |
| WO | WO 2002/019040 A2 | 3/2005 |
| WO | WO 2005/019040 A3 | 3/2005 |

* cited by examiner

*Primary Examiner*—John Q. Nguyen
*Assistant Examiner*—William E. Dondero
(74) *Attorney, Agent, or Firm*—Marshall, Gerstein & Borun LLP

(57) ABSTRACT

A spool for a supply of printing material includes a first part having a shaft on which the supply of printing material is mountable, and a second part having an opening and being arranged to retain the supply of printing material mounted on the first part. The opening is arranged to engage the shaft. One or the other of the opening and the shaft is resilient and the other of the opening and the shaft has at least one part which extends towards the said one of said opening and the shaft more than at least one other part thereof to thereby cause the second part having the opening to engage with the shaft.

38 Claims, 4 Drawing Sheets

10

SPOOL FOR SUPPLY OF IMAGE RECEIVING MEDIUM

FIELD OF THE INVENTION

The present invention relates to a spool for supporting a supply of printing material.

DESCRIPTION OF RELATED ART

Label printers are known. An example of a known label printer is the Dymo LabelWriter printer. With the known label printers, a printing mechanism is arranged to print an image on a label supply.

The label supply can take the form, for example, of discrete (so called die cut) labels on a backing sheet. Alternatively, the label supply can take the form of a continuous length of tape material on to which an image can be printed. The label material is then cut when the image has been printed.

The printing mechanisms proposed by these known label printers may use a thermal transfer mechanism. In other words, a supply of ink ribbon is used in order to obtain an image on the label supply. In particular, the label supply and the ink ribbon are passed, in an over lapping fashion, past the printing mechanism which prints an image on to the label material. Alternatively, the label material may be of a thermally sensitive nature and accordingly, the need for a ink ribbon can be avoided as the printing mechanism will print an image directly on the thermally sensitive label material. It should be appreciated that other technologies can be used in order to obtain an image on the label material.

The label supply is supported on a spool. One known spool structure comprises a first part and a second part. The first part comprises a disc with a shaft. The second part comprises a disc. The label supply is supported on the first part with the second part slid over the shaft of the first part. The position of the disc of the second part of the shaft of the first part will depend on the width of the label material. In this way, a common spool structure can be used with a range of different sizes of label supply and/or tolerances in the size of the label material can be accommodated.

With the known design, the second part stays in position on the shaft as a result of friction between the second part and the shaft. To increase the friction between the second part and the shaft, the second part is resilient around its opening which help to retain the second part in position on the smooth shaft.

However, this design has a problem. In particular, this mechanism has a tendency to allow the second part to move out of the correct position. If the second part moves out of position, the label material will not be positioned optimally in the printer. This means that the text which is printed on the labels may not be printed on the optimum position on the label material. In other words the quality of printing on the labels may be reduced.

SUMMARY OF THE INVENTION

It is an aim of embodiments of the present invention to address this problem.

According to a first aspect of the present invention, there is provided a spool for a supply of printing material, said spool comprising a first part, said first part comprising a shaft on which the supply of printing material is mountable, a second part, said second part having an opening and being arranged to retain a supply of printing material on the first part, said opening being arranged to engage said shaft, wherein one of said opening and the shaft is resilient and the other of the opening and the shaft has at least one part which extends towards the said one of said opening and the shaft more than at least one other part thereof to thereby cause said opening to engage with said shaft.

According to a second aspect of the present invention, there is provided a cassette comprising a spool for a supply of printing material, said spool comprising a first part, said first part comprising a shaft on which the supply of printing material is mountable, a second part, said second part having an opening and being arranged to retain a supply of printing material on the first part, said opening being arranged to engage said shaft, wherein one of said opening and the shaft is resilient and the other of the opening and the shaft has at least one part which extends towards the said one of said opening and the shaft more than at least one other part thereof to thereby cause said opening to engage with said shaft.

According to a third aspect of the present invention, there is provided a spool for a supply of printing material, said spool comprising a first part, said first part comprising a disc for supporting said supply of printing material and a shaft on which the supply of printing material is mountable, a second part, said second part having an opening and being arranged to retain a supply of printing material on the first part, said opening being arranged to engage said shaft, wherein said shaft comprises a plurality of grooves parallel to said shaft and in uses said opening is arranged to be received in one of said grooves.

Alternately, according to another third aspect of the present invention, there is provided a spool for a supply of printing material, said spool comprising:

a first part, said first part comprising a disc for supporting said supply of printing material and a shaft on which the supply of printing material is mountable, wherein said shaft comprises a plurality of grooves formed on the circumference of the shaft and having a portion with a reduced radius (measured from the axis of the shaft) bounded by portions having an enlarged radius, each groove running approximately perpendicular to the axis of said shaft; and a second part, said second part having an opening and being arranged to retain said supply of printing material on the first part, said opening being arranged to engage at least one groove on said shaft. By the term "portion with the reduced radius" we mean reduced relative to the "portion having an enlarged radius." In practice, the radius of the portion with the reduced radius can, for example, be the same or smaller than the radius of another portion of the shaft which does not have grooves. Similarly, the radius of the portion with the enlarged radius can, for example, be the same or larger than the radius of another portion of the shaft which does not have grooves.

BRIEF DESCRIPTION OF DRAWINGS

For a better understanding of the present invention and as to how the same may be carried into effect, reference will now be made by way of example only to the accompanying drawings in which.

DETAILED DESCRIPTION OF PREFERRED EMBODIMENTS

Figure 1:
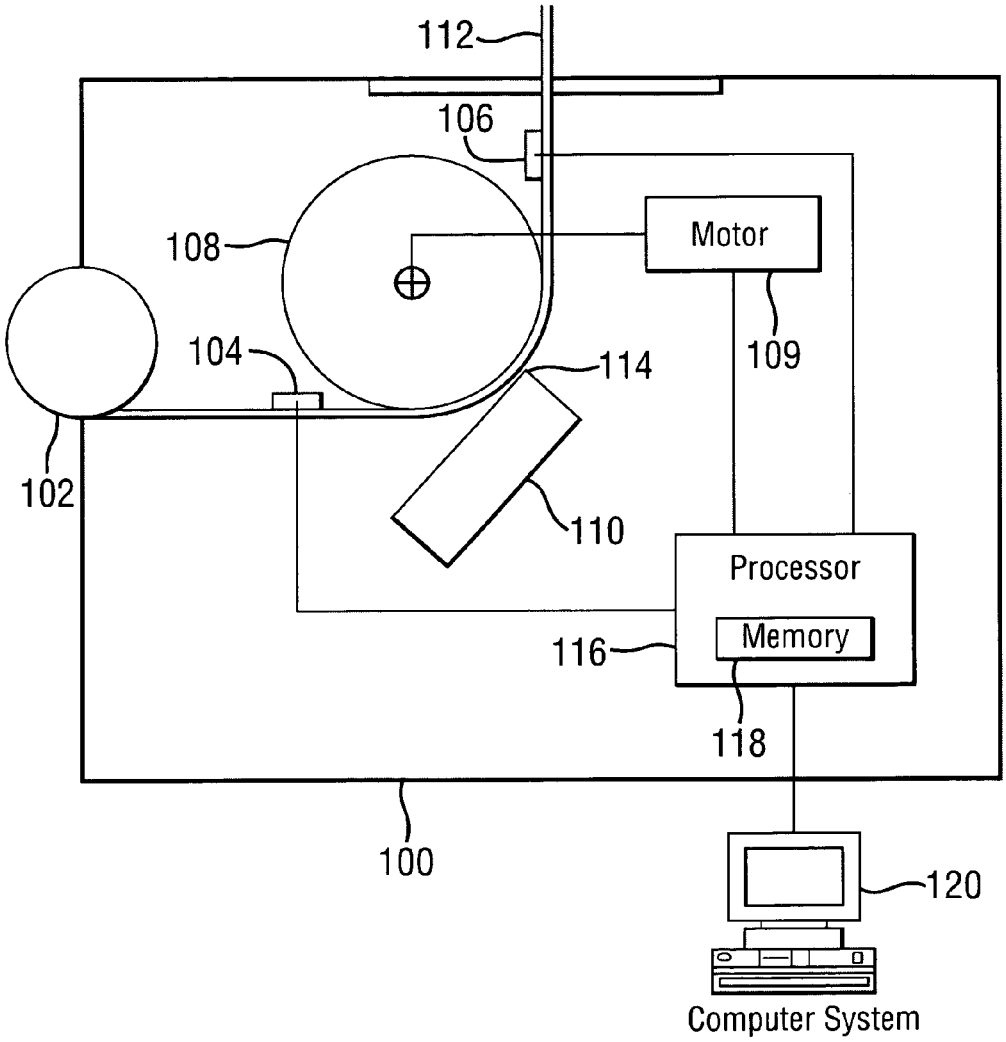
FIG. 1 is a block diagram of a label printing system for printing information on to a label of a label supply in accordance with an embodiment of the present invention.

FIG. 1 schematically shows a label printing system 10 embodying the present invention.

The label printing system 10 includes a label printer 100 and a computer system 120. The label printer 100 accepts a spool of labels 102 and prints information onto labels of the spool of labels. The label material on the spool 102 may comprise discrete or die cut labels carried on a backing layer of a continuous length of material or tape onto which an image can be printed.

The label printer 100 includes a top of form (TOF) sensor 104, a label size indicator (LSI) sensor 106, a platen 108, a motor 109, a print head 110, an exit point 112 and a processor 116. The processor 116 includes a memory module 118 for storing information including data that printer 100 collects. The TOF sensor 104 is arranged to detect TOF marks (not shown) on the label material. The TOF sensor 104 also detects the presence or absence of the label material. The LSI sensor 106 is able to detect LSI marks (not shown) on the label material and the presence or absence of the label material.

The motor 109 drives the platen 108 such that the platen turns in a clockwise or counter-clockwise direction. Rotation of the platen 108 causes the label material to advance in a forward direction if the platen 108 rotates in a counter-clockwise direction or to advance in a reverse direction if the platen 108 rotates in a clockwise direction.

Print head 110 prints information onto the label material. The print head 110 is arranged such that the information is printed at a pinch point 114 of the platen and the print head 110.

In one embodiment, the memory module 118 includes volatile and non-volatile memory. In another embodiment, the volatile memory is random access memory. In yet another embodiment, the non-volatile memory may include flash memory.

The computer system 120 sends print requests to the label printer 100. The label printer 100 sends information to the computer system 120 describing the types of labels contained on the label supply 102, whether or not the label printer 100 is ready to print and the like. This information allows the computer system 120 to format print requests to the label printer 100.

In one embodiment, the label material 102 on the spool may be accommodated in a cartridge or cassette. Use of a cartridge or cassette containing the label material allows a user to insert and/or remove labels from the label printer 100 with ease. Once the cartridge or cassette is inserted into the label printer, the label printer begins processing the label material from the cartridge or cassette. The label material is processed through the label printer in substantially the same manner as if the label material was not contained with the cartridge or cassette.

In preferred embodiments of the invention, the spool is not accommodated in a cassette or cartridge.

It should be appreciated that depending on the printing technology used, an ink ribbon may be present. If an ink ribbon is present, then that ink ribbon may be accommodated on a spool, which may or may not be in a cassette. In the case that the ink ribbon is provided in a cassette, this may be the same or different to one accommodating the label material.

The embodiment shown in FIG. 1 shows a label printer which is used in conjunction with a computer system such as a PC. It should be appreciated that in some embodiments of the present invention, the label printer may be a stand alone printer or have two modes of operation in which it is able to operate as a stand alone printer or be controlled by a computer system.

Figure 2:
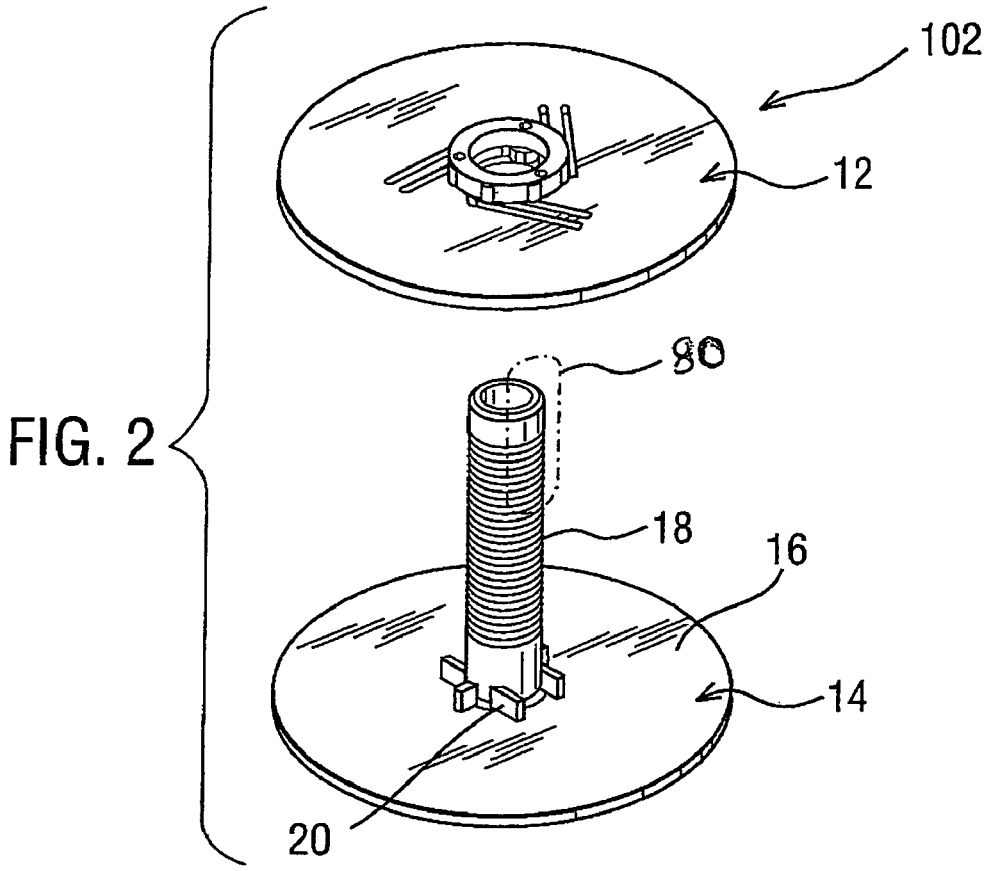
FIG. 2 shows the spool structure embodying the present invention with the first part and the second part separated.

FIG. 2 shows the spool 102 used to support the label material in more detail. It should be appreciated that a similar structure for the spool for supporting ink ribbon, if present, can be used. This spool may be provided as a stand alone supply reel, in a casing or in a cassette or cartridge.

The spool 102 comprises two parts 12 and 14. The first part 14 comprises a circular disc 16 with a shaft 18 extending perpendicular to the plane of the disc 16. The label material is in a roll and one end of the roll will be supported on the disc 16. The shaft 18 will extend through the roll of label material. Spacer elements 20 are provided around the shaft 18, at the end of the shaft 18 attached to the disc 16. These spacer elements are sized such that the inner circumference of roll of tape supply will snugly fit around the ends of the spacer elements 20 remote from the shaft. The spacer elements thus maintain the orientation of the label supply roll with respect to the shaft 18.

Figure 4:
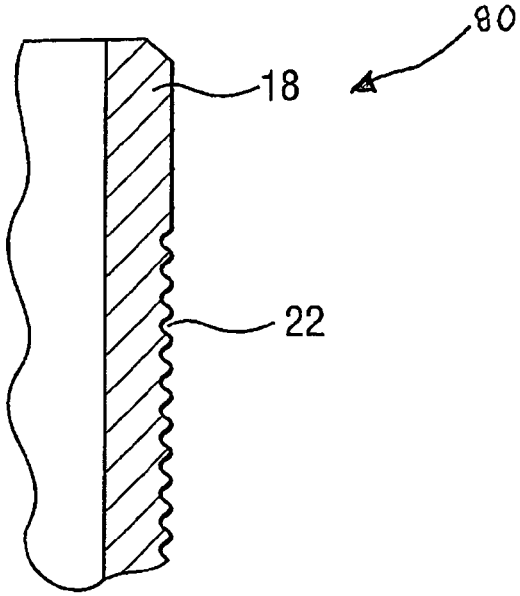
FIG. 4 shows a detail of the shaft of the first part shown in FIG. 2 in more detail.

Reference is made to FIG. 4 which shows the outer circumference of the shaft 18 in more detail. In particular, as can be seen from FIG. 2, section 80 is shown in more detail in FIG. 4. In particular, the outer circumference of the shaft 18 comprises a plurality of grooves. The grooves 22 are generally circular and are each contained in a plane parallel to the disc 16. The grooves may take any suitable form. It should be appreciated that in alternative embodiments of the present invention, the grooves may take the form of a screw threading.

Figure 3:
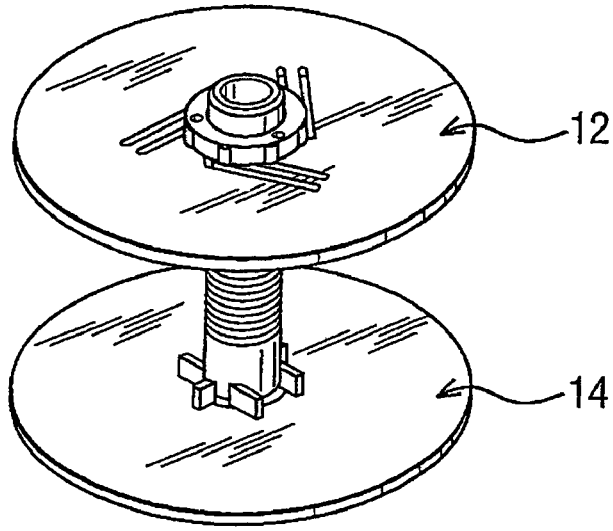
FIG. 3 shows a spool structure of FIG. 2 with the second part positioned on the first part.
Figure 5:
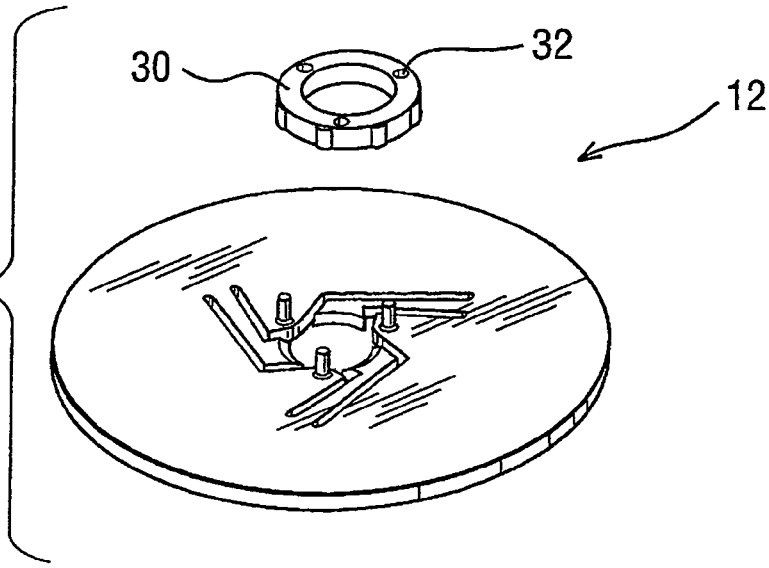
FIG. 5 shows the construction of the second part in more detail.
Figure 6A:
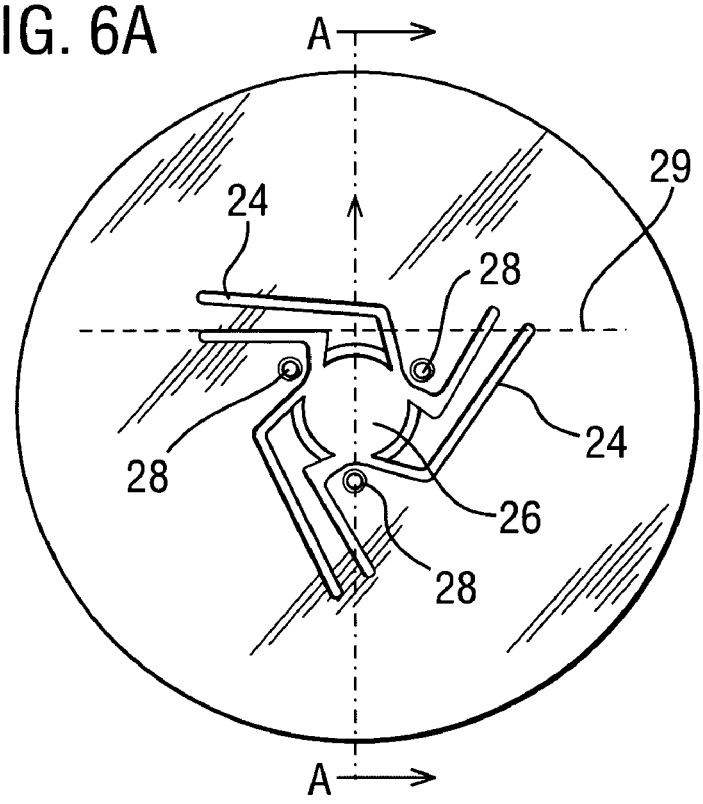
FIG. 6*a* shows the disc of the second part in more detail.
Figure 6B:
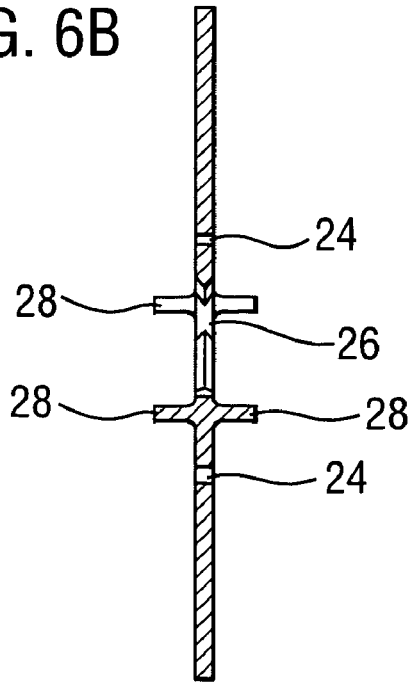
FIG. 6*b* shows a cross section of the disc of FIG. 6*a* along line AA.

As can be seen from FIG. 3, the second part comprises a disc 12 which is mounted on the shaft 18. The plane of disc 12 is arranged in use to be parallel to that of disc 14. The disc 12 will now be described in more detail. The disc 12 can be seen in more detail in FIGS. 5, 6*a* and 6*b*. The disc 12 is arranged to be the same on both sides. Accordingly, the disc has cut out portions 24 which extend from a central opening. These cut out portions 24 are arranged to provide resilience. The opening 26 is sized so as to be slightly smaller than the outer circumference of the shaft 18. The cut out portions 24 thus mean that when the disc 12 is pushed onto the shaft, the opening 26 can be expanded so that it can accommodate the shaft. The cut out portions 24 then provide a resilient effect urging the sides of the opening 26 against the sides of the shaft.

In embodiments of the invention, the periphery of the opening 26 is sized to be accommodated in one of the grooves 22. The opening is thus preferably sized so as to be slightly smaller than the inner circumference of the groove 22. This means that when the edge of the opening 26 is accommodated in a groove 22, the cut out portions 24 will urge the sides of the opening 26 into the groove 22 thus retaining the disc 12 securely in place.

The cut out portions or openings can take any suitable shape and size and will depend on the material used to make the disc 12. In one embodiment of the invention, six cut out portions are provided, arranged in pairs around the opening of the disc. The cut out portions in one embodiment of the present invention are not arranged to extend along a radius of the disc but instead extend from the opening 26 in a dog leg manner. The second part of the dog leg is arranged to cross a number of different radii of the disc. It will be appreciated by the skilled man that any suitable configuration and shape for the cut out portions can be adopted.

The shape of the cut out portions is optimised to move over the grooves, but only when a predetermined minimum force is applied. When the disc is to be moved from one groove to the next, the cut out portions give in a radial direction. The torque to rotate each cut and portion about its virtual point of rotation is maximized when the second part of the dog leg of each cut out portion is generally perpendicular to the radial force on this cut out portion. For example line 29 which follows the second part of the dog leg of one cut out portion is perpendicular to the radial force along line A—A. The length of the cut out portions in combination with their shape determines the required force to move the disc from one groove to another.

Additionally, the disc 12 has three pegs 28 on each side of the disc, around the opening. These pegs 28 are arranged to retain a ring shaped cap 30 in place. In practice, one cap is provided on each side of the disc 12. The caps force the cut out portions to move in a radial direction and not in an axial direction. The caps also help retain the label supply in position. It should be appreciated that in some embodiments of the present invention one or more of these caps may be omitted. However preferred embodiments of the invention use two caps to keep the second part symmetrical and avoid that the second part is used in the wrong position.

The caps comprise ring like structures which have holes, e.g., three holes 32, to accommodate the respective pegs 28. The inner circumference of the ring is sized so as to be slightly larger than the circumference of opening 26. The inner circumference of the ring is advantageously at least as large as the portions of the shaft which will pass through the ring. This is because the ring 30 will not have resilience and accordingly must be big enough to accommodate the largest outer circumference of the shaft 18.

The outer circumference 30 of the ring is sized to provide a similar function to the spacers 20. In other words, the outer circumference 30 of the ring on the lower side of the disc will be accommodated internally of the supply of labels.

The spool shown in the figures is arranged to be reusable. Accordingly, the user can place a supply of labels over the shaft and put the disc 12 over the end of the shaft. The disc is pushed down until it makes contact with the label spool. Since the edge of the opening 26 is engaged in a groove, when the disc is retained in its final position, against the end of the label supply, it will remain in that position during use. Accordingly, the problems of the prior art, namely that the disc 12 moves, are avoided. In this way, it can be ensured that the position of the label supply with respect to the print head remains unchanged and accordingly the resulting quality of print can be improved as compared to the prior art.

The supply of labels can be replaced by a supply of labels having a different dimension. The disc will then be moved accordingly to take into account the different supply of labels.

In alternative embodiment of the present invention, the spool is arranged to be used once only. However, the same spool can be used with a range of different label supply sizes. This makes the manufacture of the label supplies much easier.

In preferred embodiments of the present invention, the spool is made of a suitable plastics material. In one preferred embodiment of the present invention, the first part of the spool comprises a one piece structure.

Embodiments of the present invention have described the opening of the second part as being resilient. It should be appreciated that the shaft may be of a resilient material such as rubber or plastics or may be coated with a resilient layer of material.

In some embodiments of the invention, both the opening and the shaft may be resilient.

In preferred embodiments of the invention, the resilience of the opening has been provided by the shape of the cut away portions. It should be appreciated that in some embodiments of the invention, the second part may be made of a resilient material.

In preferred embodiments of the invention, the shaft is provided with grooves. The grooves may be replaced by at least one projection or at least one recess which is engagable by the opening.

In one embodiment of the invention, the support disc of the first part may be omitted. For example, the second part may be provided with one cap only. The diameter of the shaft would then match the internal dimension of the label supply. The second part could then be supported on the shaft with the cap to the outside. Alternatively or additionally at least part of the function of the support disc may be provided by the label printer.

The invention claimed is:

1. A spool for a supply of printing material, said spool comprising:

a first part, said first part comprising a shaft on which the supply of printing material is mountable, a second part, said second part having an opening and being arranged to retain the supply of printing material mounted on the first part, said opening being arranged to engage said shaft, wherein said opening is resilient and the shaft has at least one part which extends towards the opening more than at least one other part thereof to thereby cause said opening to engage with said shaft, wherein said second part has a plurality of apertures arranged around and extending from said opening to provide resilience, and wherein said apertures at least partially extend in directions approximately tangentially to said opening.

2. The spool of claim 1, wherein said at least one part and said at least one other part define at least one groove.

3. The spool of claim 1, wherein said at least one part and said at least one other part define a plurality of different positions on said shaft on which said second part is engagable.

4. The spool of claim 1, wherein a plurality of grooves are provided.

5. The spool of claim 4, wherein said plurality of grooves are parallel.

6. The spool of claim 1, wherein the first part comprises a support disc from which said shaft extends.

7. The spool of claim 1, wherein said spool is capable of receiving different sizes of printing material.

8. The spool of claim 1, wherein said at least one part and the other part are arranged to extend around said other of said opening and the shaft.

9. The spool of claim 1, wherein said apertures are elongated in shape.

10. The spool of claim 1, wherein said second part comprises a disc.

11. The spool of claim 1, wherein said second part comprises at least one cap around said opening.

12. The spool of claim 11, wherein said cap is ring shaped.

13. The spool of claim 11, wherein said second part has at least one peg for engagement with said cap.

14. The spool of claim 11, wherein said second part comprises two caps disposed on opposite sides of said opening.

15. The spool of claim 11, wherein a cap is provided around said opening and in use is arranged to be received in an interior diameter of a rolled supply of printing material.

16. The spool of claim 1, wherein at least one of said first and second part comprises a plastic material.

17. The spool of claim 1, wherein said printing material comprises a label supply or an ink ribbon supply.

18. A spool for a supply of printing materials, said spool comprising:

a first spool part, said first spool part comprising a shaft on which the supply of printing material is mountable, a second spool part, said second spool part having an opening and being arranged to retain the supply of printing material mounted on the first spool part, said opening being arranged to engage said shaft, wherein said opening is resilient and the shaft has at least one part which extends towards the opening more than at least one other part thereof to thereby cause said opening to engage with said shaft, wherein said second spool part has a plurality of apertures around said opening to provide resilience, and wherein said apertures have a first aperture part which extends from said opening and a second aperture part extending in directions approximately to a radius of said second spool part.

19. The spool of claim 18, wherein said at least one part and said at least one other part define at least one groove.

20. The spool of claim 18, wherein said at least one part and said at least one other part define a plurality of different positions on said shaft on which said second part is engagable.

21. The spool of claim 18, wherein a plurality of grooves are provided.

22. The spool of claim 21, wherein said plurality of grooves are parallel.

23. The spool of claim 18, wherein the first part comprises a support disc from which said shaft extends.

24. The spool of claim 18, wherein said spool capable of receiving different sizes of printing material.

25. The spool of claim 18, wherein said at least one part and the other part are arranged to extend around said other of said opening and the shaft.

26. The spool of claim 18, wherein said apertures are elongate in shape.

27. The spool of claim 18, wherein said second part comprises a disc.

28. The spool of claim 18, wherein said second part comprises at least one cap around said opening.

29. The spool of claim 28, wherein said cap is ring shaped.

30. The spool of claim 28, wherein said second part has at least one peg for engagement with said cap.

31. The spool of claim 28, wherein said second part comprises two caps disposed on opposite sides of said opening.

32. The spool of claim 28, wherein a cap is provided around said opening and in use is arranged to be received in an interior diameter of a rolled supply of printing material.

33. The spool of claim 18, wherein at least one of said first and second part comprises a plastic material.

34. The spool of claim 18, wherein said printing material comprises a label supply or an ink ribbon supply.

35. A cassette comprising a spool for a supply of printing material, said spool comprising:

a first part, said first part comprising a shaft on which the supply of printing material is mountable, a second part, said second part having an opening and being arranged to retain a supply of printing material on the first part, said opening being arranged to engage said shaft, wherein said opening is resilient and the shaft has at least one part which extends towards the opening more than at least one other part thereof to thereby cause said opening to engage with said shaft, wherein said second spool part has a plurality of apertures around said opening to provide resilience, and wherein said apertures at least partially extend in directions approximately tangentially to said opening.

36. A cassette comprising a spool for a rolled supply of printing material, said spool comprising:

a first part comprising a shaft on which the supply of printing material is mountable, a second part comprising an opening and a plurality of apertures arranged around said opening, wherein the second part is arranged to engage said shaft and to retain a supply of printing material mounted on the first part, wherein the shaft has at least one part which extends towards the opening more than at least one other part thereof to thereby cause said opening to engage with said shaft, and wherein said apertures have a first aperture part which extends from said opening and a second aperture part extending in directions approximately perpendicular to a radius of said second spool part.

37. The cassette comprising a spool of claim 36, wherein the plurality of apertures are adapted to make the opening resilient.

38. The cassette comprising a spool of claim 36, wherein the shaft comprises a plurality of grooves forming areas with a smaller radius bounded by areas having relatively larger radius, wherein said opening is positioned to engage said shaft at an area with the smaller radius.

* * * * *